US011673282B2

(12) United States Patent
Good et al.

(10) Patent No.: US 11,673,282 B2
(45) Date of Patent: Jun. 13, 2023

(54) SENSOR-BASED SHAVING SYSTEMS AND METHODS OF ANALYZING A USER'S SHAVE EVENT FOR DETERMINING A UNIQUE THRESHOLD VALUE OF THE USER

(71) Applicant: The Gillette Company LLC, Boston, MA (US)

(72) Inventors: Ian Anthony Good, Reading (GB); Balasundram Periasamy Amavasai, Reading (GB); Christopher Francis Rawlings, Reading (GB); Amanda Washington, Mendon, MA (US); Susan Clare Robinson, Windsor (GB); Claus Hittmeyer, Dietzenbach (DE); Werner Friedrich Johann Bonifer, Eschborn (DE); Weiyan Yang, Frankfurt am Main (DE); Angela Louise Richardson, Henley on Thames (GB); Alexander James Hinchliffe Friend, Market Drayton (GB); Nicola Dawn Dixon, Swindon (GB); Shirley Namubiru, Reading (GB); Joshua Thomas Kissel, Cincinnati, OH (US); Michael Thomas Roller, Cincinnati, OH (US); Venugopal Vasudevan, Oakley, OH (US); Robert Thomas Hinkle, Sharonville, OH (US)

(73) Assignee: The Gillette Company LLC, Boston, MA (US)

( * ) Notice: Subject to any disclaimer, the term of this patent is extended or adjusted under 35 U.S.C. 154(b) by 575 days.

(21) Appl. No.: 16/920,288

(22) Filed: Jul. 2, 2020

(65) Prior Publication Data

US 2022/0001556 A1 Jan. 6, 2022

(51) Int. Cl.
*B26B 19/38* (2006.01)

(52) U.S. Cl.
CPC ..... *B26B 19/388* (2013.01)

(58) Field of Classification Search
CPC .... B26B 19/00; B26B 19/3873; B26B 19/388
See application file for complete search history.

(56) References Cited

U.S. PATENT DOCUMENTS 3,373,747 A * 3/1968 Tapper ..... A61N 1/36003 30/34.2
3,678,944 A * 7/1972 Berry ..... B26B 19/00 132/213.1

(Continued)

OTHER PUBLICATIONS

Extended European Search Report and Search Opinion; Application No. 21182030.3 ; dated Nov. 30, 2021; 06 pages.

*Primary Examiner* — Adam J Eiseman
*Assistant Examiner* — Richard D Crosby, Jr.
(74) *Attorney, Agent, or Firm* — Kevin C. Johnson

(57) ABSTRACT

Sensor-based shaving systems and methods of analyzing a user's shave event are described for determining a unique threshold value of the user. A grooming device comprises a handle having a connecting structure connected to a hair cutting implement. A shave event sensor associated with the grooming device measures a user behavior, which includes collecting a first dataset comprising shave data defining a shave event. The first dataset is transmitted via a communication device and is analyzed to determine baseline behavior data of the user, and a unique threshold value of the user is determined from the baseline behavior data. One or more subsequent datasets, each comprising shave data of one or more corresponding shave events, is compared to the unique threshold value to determine comparison data. An indication (Continued)

is provided, based on the comparison data, to indicate a deviation from the threshold value and to influence the user behavior.

35 Claims, 7 Drawing Sheets

(56) References Cited

U.S. PATENT DOCUMENTS

| | | | | |
|---|---|---|---|---|
| 9,821,479 | B2 * | 11/2017 | Zuidervaart | B26B 19/42 |
| 10,131,061 | B2 * | 11/2018 | Krans | B26B 21/4056 |
| 10,882,199 | B2 * | 1/2021 | Zandsteeg | A45D 44/005 |
| 11,027,442 | B2 * | 6/2021 | Fuellgrabe | B26B 19/042 |
| 11,186,001 | B2 * | 11/2021 | Uit De Bulten | B26B 21/4081 |
| 11,224,981 | B2 * | 1/2022 | Westerhof | B26B 19/388 |
| 11,260,550 | B2 * | 3/2022 | Neyer | B26B 19/382 |
| 11,318,630 | B2 * | 5/2022 | Zandsteeg | B26B 19/388 |
| 11,504,866 | B2 * | 11/2022 | Tsegenidis | B26B 21/4087 |
| 2002/0088121 | A1 * | 7/2002 | Jacobsen | B26B 21/40 30/32 |
| 2005/0216035 | A1 * | 9/2005 | Kraus | B26B 19/388 606/133 |
| 2010/0170052 | A1 * | 7/2010 | Ortins | A63F 13/213 15/106 |
| 2011/0197726 | A1 * | 8/2011 | Kraus | B26B 19/046 83/13 |
| 2012/0227554 | A1 * | 9/2012 | Beech | B26B 19/382 83/13 |
| 2013/0021460 | A1 * | 1/2013 | Burdoucci | B26B 19/388 382/103 |
| 2013/0250122 | A1 * | 9/2013 | Binder | H04N 13/239 348/162 |
| 2014/0137883 | A1 * | 5/2014 | Rothschild | B26B 19/388 132/200 |
| 2014/0345142 | A1 * | 11/2014 | Damkat | B26B 21/405 30/34.2 |
| 2015/0217465 | A1 * | 8/2015 | Krenik | B26B 19/388 700/90 |
| 2016/0262521 | A1 * | 9/2016 | Kustra | G06T 7/38 |
| 2016/0263754 | A1 * | 9/2016 | Lauritsen | A45D 24/36 |
| 2018/0236675 | A1 | 8/2018 | Westerhof et al. | |
| 2019/0224864 | A1 | 7/2019 | Robinson et al. | |
| 2019/0224865 | A1 | 7/2019 | Robinson et al. | |
| 2019/0299436 | A1 | 10/2019 | Fuellgrabe et al. | |
| 2022/0088808 | A1 * | 3/2022 | Westerhof | G06F 3/0482 |

* cited by examiner

SENSOR-BASED SHAVING SYSTEMS AND METHODS OF ANALYZING A USER'S SHAVE EVENT FOR DETERMINING A UNIQUE THRESHOLD VALUE OF THE USER

FIELD OF THE INVENTION

The present disclosure generally relates to sensor-based shaving systems and methods, and more particularly to, sensor-based shaving systems and methods of analyzing a user's shave event for determining a unique threshold value of the user.

BACKGROUND OF THE INVENTION

Generally, shave performance can be summarized as a trade-off between closeness and irritation, where an individual typically can either achieve, on the one hand, an increased closeness of shave (removing more hair) but risking irritation or redness of his or her skin, or, on the other hand, a less close shave (leaving more hair) but reducing the risk of skin irritation. Individuals typically try to balance this trade-off to get their desired end result by manually regulating the quantity, direction and pressure (or load) of strokes applied during a shave. Taking an increased quantity of strokes, taking strokes going against the direction of hair growth or applying increased pressure during strokes will typically result in both increased closeness and increased risk of skin irritation. However, there is typically a threshold value for such shave parameters, going beyond this threshold value will yield minimal increase closeness benefit while yielding a high risk of unwanted skin irritation.

Thus a problem arises for existing shaving razors, and the use thereof, where individuals desiring a close shave generally apply too many strokes, too many strokes going against the hair growth direction and/or too much pressure (or load) during a shave session, under the false impression that it will improve the closeness of the end result. The problem is acutely pronounced given the various versions, brands, and types of shaving razors currently available to individuals, where each of the versions, brands, and types of shaving razors have different components, blades, sharpness, and/or otherwise different configurations, all of which can vary significantly in the quantity, direction and pressure (or load) of strokes required, and for each shaving razor type, to achieve a close shave (e.g., with little or no hair remaining) with little or no skin irritation. This problem is particularly acute because such existing shaving razors—which may be differently configured—provide little or no feedback or guidance to assist the individual achieve a close shave without skin irritation.

For the foregoing reasons, there is a need for sensor-based shaving systems and methods of analyzing a user's shave event for determining a unique threshold value of the user.

SUMMARY OF THE INVENTION

Sensor-based shaving systems and methods are described herein regarding analyzing a user's shave event for determining a unique threshold value of the user. Generally, the sensor-based shaving systems and methods comprise a grooming device (e.g., a shaving razor such as a wet shave razor). The grooming device can include a handle and a connecting structure for connecting a hair cutting implement (e.g., a razor blade). The grooming device can also comprise, or be associated with, a shave event sensor (e.g., a load sensor) to collect shaving data of a user. Live feedback and/or indicators may be provided the user via an indication, e.g., green light-emitting diode (LED) feedback when the user is applying pressure within or below a unique threshold value, or a red LED feedback when the user is applying pressure above the unique threshold value of the user.

Indication and/or load feedback features, as provided by the sensor-based shaving systems and methods, warn users to deter behavior that causes skin irritation, and encourages behavior that reduces skin irritation. For this reason, reducing a specific load threshold of a user (e.g., a unique threshold value) that the user should not exceed during a shave stroke can allow the user to prevent skin damage. For example, a vast majority of user shave strokes typically lie within the range of 50 gram-force (gf) to 500 gf, and the average peak load during a shave stroke is approximately in the range of 200 gf to 250 gf. Based on this data, a load threshold value of a user (e.g., a unique threshold value), for example 250 gf, can be set for a grooming device, e.g., at least as an initial target value, to encourage a user to change his or her behavior to bring his or her specific load or pressure (as applied to his or her skin or face) to within a lower half of the typical load range. Reduction of load or pressure to a user's skin or face provides an irritation benefit, and at a specific user level using the unique threshold value, specific to each user, as described herein.

Generally, in various embodiments, unique, specific, and/or personalized threshold values, as implemented by a grooming device as described herein, may be generated to provide corresponding specific users with unique, specific, and/or personalized indications of stroke count, stroke direction or stroke pressure (load) for the purpose of reducing skin irritation. As provided herein, a grooming device, having a handle and a shaving implement, and communicatively coupled to a sensor and a communication device, may be provided to the user. The communication device may transmit shaving data and/or datasets from the sensor to a processor based computing device (which may be on the handle and/or remote from the grooming device). The shaving data and/or dataset(s) may be analyzed by the processor based computing device to determine relevant shave events, e.g. whole shaves or individual strokes. Shave events from a first dataset may be analyzed by the processor based computing device to determine a unique threshold value of the user. In addition, subsequent dataset(s) may be compared to the unique threshold value of the user, where a comparison result, e.g., in the form of an indication (e.g., an LED indication or otherwise as described herein) may be communicated to the user.

More specifically, in accordance with various embodiments herein, a sensor-based shaving method of analyzing a user's shave event is disclosed for determining a unique threshold value of the user. The sensor-based shaving method may comprise providing a grooming device to a user. The grooming device may include a handle comprising a connecting structure, and a hair cutting implement connected to the connecting structure. The sensor-based shaving method may comprise providing a shave event sensor to the user, the shave event sensor is configured to measure a user behavior associated with a shave event. The sensor-based shaving method may further comprise providing a communication device to the user. The sensor-based shaving method may further comprise collecting a first dataset from the shave event sensor. The first dataset may comprise shave data defining the shave event. The sensor-based shaving method may further comprise analyzing the first dataset to determine baseline behavior data of the user. The sensor-based shaving method may further comprise analyzing the baseline behavior data to determine a unique threshold value of the user that is different from the baseline behavior data. The sensor-based shaving method may further comprise comparing one or more subsequent datasets, each comprising shave data of one or more corresponding shave events, to the unique threshold value of the user to determine comparison data. The sensor-based shaving method may further comprise providing, based on the comparison data, an indication to indicate a deviation from the threshold value and to influence the user behavior.

In additional embodiments, as described herein, a sensor-based shaving system is configured to analyze a user's shave event for determining a unique threshold value of the user. The sensor-based shaving system comprises a grooming device having (i) a handle comprising a connecting structure, and (ii) a hair cutting implement. The hair cutting implement is configured to connect with the connecting structure. The sensor-based shaving system may further comprise a shave event sensor configured to measure a user behavior associated with a shave event of a user. The sensor-based shaving system may further comprise a communication device. The sensor-based shaving system may further comprise a processor, configured onboard or off-board the grooming device, and communicatively coupled to the shave event sensor and the communication device. In various embodiments, the processor may further be configured to execute computing instructions stored on a memory communicatively coupled to the processor. The instructions may cause the processor to collect a first dataset from the shave event sensor. The first dataset may comprise shave data defining the shave event. The instructions may further cause the processor to analyze the first dataset to determine baseline behavior data of the user. The instructions may further cause the processor to analyze the baseline behavior data to determine a unique threshold value of the user that is different from the baseline behavior data. The instructions may further cause the processor to compare one or more subsequent datasets, each comprising shave data of one or more corresponding shave events, to the unique threshold value of the user to determine comparison data. The instructions may further cause the processor to provide, based on the comparison data, an indication to indicate a deviation from the threshold value and to influence the user behavior.

In accordance with the above, and with the disclosure herein, the present disclosure includes improvements in computer functionality or in improvements to other technologies at least because the disclosure describes that, e.g., in some embodiments, a grooming device and/or a server to which the grooming device is communicatively connected, is improved where the intelligence or predictive ability of the server or grooming device is enhanced by a trained (e.g., machine learning trained) sensor-based learning model. In such embodiments, the sensor-based learning model, executing on the server, is able to accurately identify, based on shave data and/or datasets of a specific user, a unique threshold value designed for implementation on a grooming device to provide an indication to indicate a deviation from the threshold value and to influence the user behavior. That is, the present disclosure, with respect to some embodiments, describes improvements in the functioning of the computer itself or "any other technology or technical field" because the grooming device, and/or the server to which it is communicatively connected, is enhanced with a sensor-based learning model to accurately predict, detect, or determine unique threshold values of various users. This improves over the prior art at least because existing systems lack such predictive or classification functionality and are simply not capable of accurately analyzing shave data and/or datasets of a specific user to determine a unique threshold value of a user that is designed for implementation on a grooming device to provide an indication to indicate a deviation from the unique threshold value and to influence the user behavior.

For similar reasons, the present disclosure relates to improvement to other technologies or technical fields at least because the present disclosure describes or introduces improvements to computing devices in the field of shaving razors, whereby a grooming device, as described herein, is updated and enhanced with a unique threshold value, implemented on the grooming device, to provide an indication to indicate a deviation from the unique threshold value and to influence the user behavior.

In addition, the present disclosure includes applying certain of the claim elements with, or by use of, a particular machine, e.g., a grooming device having a handle comprising a connecting structure, and a hair cutting implement, the hair cutting implement being connected to the connecting structure. In addition present disclosure includes applying certain of the claim elements with, or by use of, a particular machine, e.g., a shave event sensor configured to measure a user behavior associated with a shave event of a user.

In addition, the present disclosure includes specific features other than what is well-understood, routine, conventional activity in the field, or adding unconventional steps that confine the claim to a particular useful application, e.g., analyzing a user's shave event for determining a unique threshold value of the user as described herein.

Advantages will become more apparent to those of ordinary skill in the art from the following description of the preferred embodiments which have been shown and described by way of illustration. As will be realized, the present embodiments may be capable of other and different embodiments, and their details are capable of modification in various respects. Accordingly, the drawings and description are to be regarded as illustrative in nature and not as restrictive.

BRIEF DESCRIPTION OF THE DRAWINGS

The Figures described below depict various aspects of the system and methods disclosed therein. It should be understood that each Figure depicts an embodiment of a particular aspect of the disclosed system and methods, and that each of the Figures is intended to accord with a possible embodiment thereof. Further, wherever possible, the following description refers to the reference numerals included in the following Figures, in which features depicted in multiple Figures are designated with consistent reference numerals.

There are shown in the drawings arrangements which are presently discussed, it being understood, however, that the present embodiments are not limited to the precise arrangements and instrumentalities shown, wherein.

The Figures depict preferred embodiments for purposes of illustration only. Alternative embodiments of the systems and methods illustrated herein may be employed without departing from the principles of the invention described herein.

DETAILED DESCRIPTION OF THE INVENTION

Figure 1:
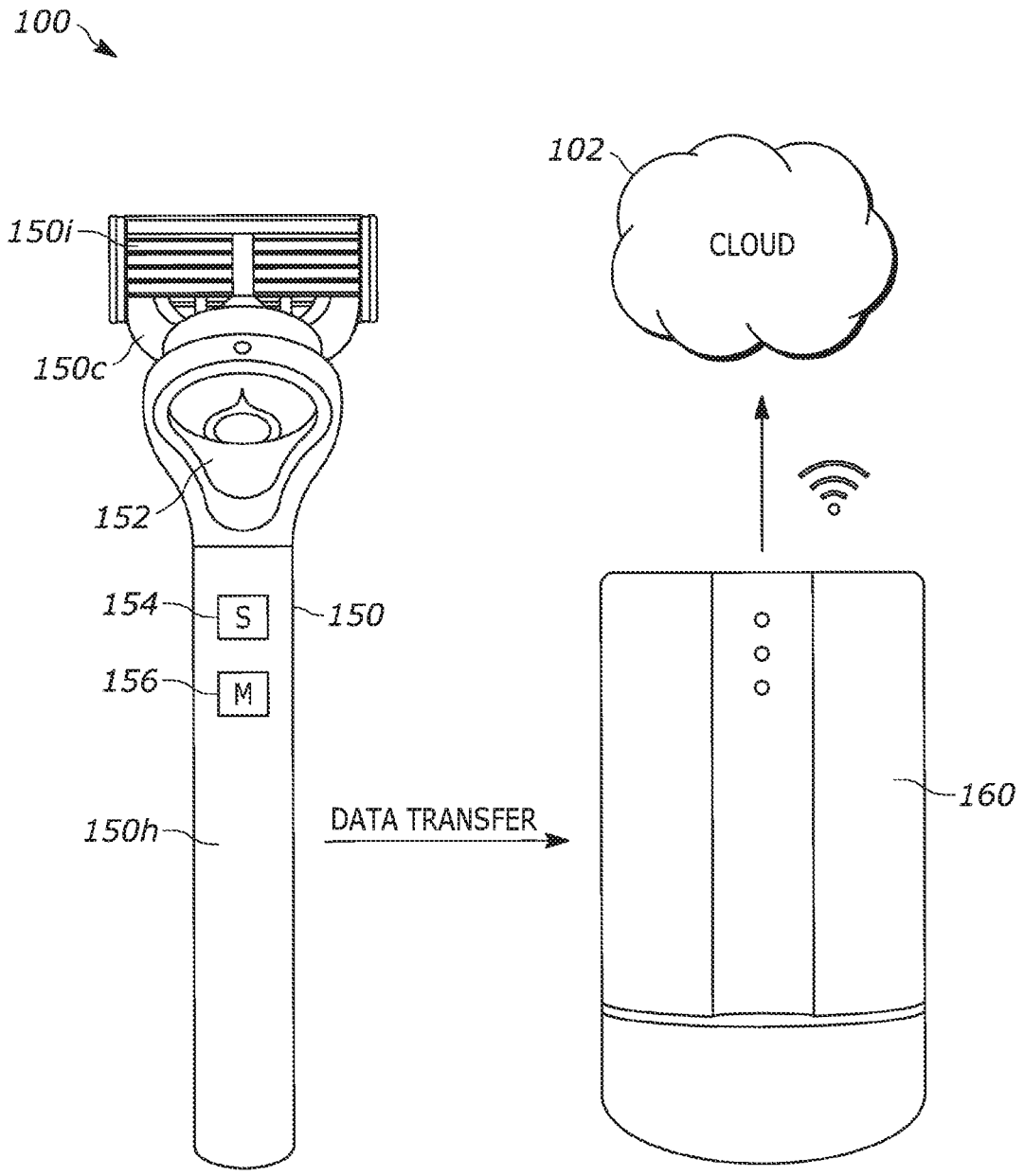
FIG. 1 illustrates an example sensor-based shaving system configured to analyze a user's shave event for determining a unique threshold value of the user in accordance with various embodiments disclosed herein.

FIG. 1 illustrates an example sensor-based shaving system 100 configured to analyze a user's shave event for determining a unique threshold value of the user in accordance with various embodiments disclosed herein. As shown in the embodiment of FIG. 1, sensor-based shaving system 100 comprises a grooming device 150 having (i) a handle 150*h* comprising a connecting structure 150*c*, and (ii) a hair cutting implement 150*i* connected to the connecting structure 150*c*. In the embodiment of embodiment of FIG. 1, grooming device 150 is illustrated as a shaving razor with a detachable hair cutting implement 150*i* (e.g., a razor blade). A grooming device, as described herein, may comprise other similar grooming devices, including, for example, but not limited to at least one of an electric shaver, a shaving razor, or an epilator.

Figure 2:
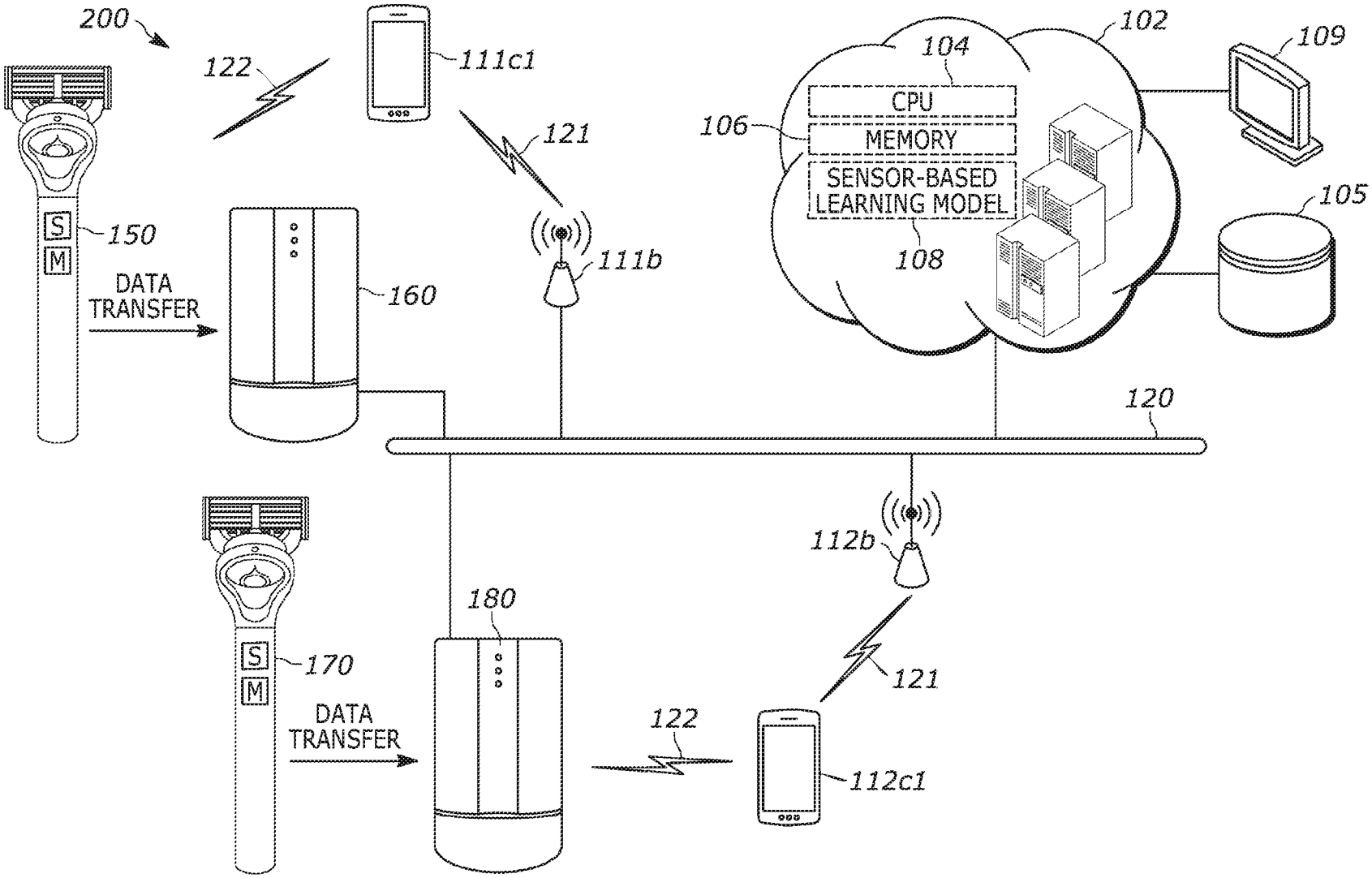
FIG. 2 illustrates a further example of a sensor-based shaving, having multiple grooming devices, and configured to analyze a user shave event(s) for determining respective unique threshold value(s) for respective users in accordance with various embodiments disclosed herein.

Sensor-based shaving system 100 further comprises a shave event sensor 154 (e.g., a load sensor) configured to measure a user behavior associated with a shave event of a user. Shave event sensor 154 may comprise one or more of a displacement sensor, a load sensor, a movement sensor, an optical sensor, an audio sensor, a temperature sensor, a mechanical button, an electronic button, or a software button (e.g., the software button being part of an app running on a user computing device in communication with grooming device 150). In the embodiment of FIG. 1, shave event sensor 154 is communicatively coupled to grooming device 150, where shave event sensor 154 is positioned on grooming device 150. In other embodiments, shave event sensor 154 may be communicatively coupled, e.g., via wired or wireless communication, to a charger of a grooming device (e.g., grooming device 150), a base station of a grooming device (e.g., grooming device 150), or a computing device having a processor (e.g., user computing device 111*c*1 as illustrated in FIG. 2 herein) executing a digital app.

Sensor-based shaving system 100 further comprises a communication device. In various embodiments the communication device may be a wired or wireless transceiver positioned on or within grooming device 150. The communication device may comprise any one or more of a wired connection or a wireless connection, such as a Bluetooth connection, a Wi-Fi connection, a cellular connection and/or an infrared connection. In various embodiments, the communication device is communicatively coupled to the grooming device, a charger of the grooming device, a base station of the grooming device, or a computing device having a processor (e.g., user computing device 111*c*1 as illustrated in FIG. 2 herein) executing a digital application.

Sensor-based shaving system 100 further comprises a processor 156 (e.g., a microprocessor) and is communicatively coupled to shave event sensor 154 and the communication device. Processor 156 is configured to receive, transmit, and analyze data (e.g., shave data) as provided from shave event sensor 154 and/or the communication device. In various embodiments, processor 156 is configured to execute computing instructions stored on a memory (e.g. of grooming device 150) communicatively coupled to processor 156. The instructions may cause processor 156 to collect a first dataset from the shave event sensor. The first dataset may comprise shave data defining a shave event. In various embodiments described herein, the first dataset may comprise data defining one or more shaving strokes, one or more shaving sessions, or user input (e.g., configuration data or profile data of a user).

The instructions may further cause processor 156 to analyze the first dataset to determine baseline behavior data of the user. Baseline behavior data of the user may be calculated by processor 156, which may be onboard or offboard (e.g., remote) to a grooming device, based on any one or more of a total value of the first dataset, an average value of the first dataset, a maximum value of the first dataset, a minimum value of the first dataset, an average peak value of the first dataset, a frequency of the first dataset, and/or an integration of the first dataset.

The instructions may further cause processor 156 to analyze the baseline behavior data to determine a unique threshold value of the user. The unique threshold value is different from the baseline behavior data. For example, the unique threshold value may comprise one or more of a load value, a temperature value, a shave count, a stroke count, a stroke speed, a stroke distance, a stroke duration, a shave duration, a stroke location, a shave location, a device parameter, a hair parameter, and/or a skin parameter. In various embodiments, the unique threshold value of a user may be calculated based an offset, a percentile, an average, and/or a statistical derivation from the baseline behavior data.

The instructions may further cause processor 156 to compare one or more subsequent datasets, each comprising shave data of one or more corresponding shave events, to the unique threshold value of the user to determine comparison data. In various embodiments, the comparison data may comprise a positive value, a negative value, a neutral value, an absolute value, or a relative value.

The instructions may further cause processor 156 to provide, based on the comparison data, an indication 152 to indicate a deviation from the threshold value and to influence the user behavior. For example, in the embodiment of FIG. 1, the indication is provided by or is a red-green-blue (RGB) based feedback light-emitting-diode (LED). Thus in the embodiment of FIG. 1, the communication device is configured to provide an indication directly to the user, wherein a positive state is indicated via a green signal, and wherein a negative state is indicated via a red signal. While the embodiment of FIG. 1 illustrates one type of indication, an indication may comprise any one or more of a visual indicator, a light emitting diode (LED), a vibrator, or an audio indicator. Additionally, or alternatively, an indication may also comprise a display indication as implemented via an application (app) executing on a user computing device (e.g., user computing device 111*c*1). The app may execute instructions, via a programming language, to receive the shave data and render it on a display screen of the user computing device. For example, an app may be implemented via one or more app programming languages including, for example, via SWIFT or Java for APPLE iOS and Google Android platforms, respectively. In various embodiments, a display or GUI indication may include one or more visualizations of post-shave data, score(s) based on the shave data (e.g. load or pressure scores), data output (e.g., either raw data or processed data), and/or graphs of the data (e.g., either raw data or processed data). Such display(s), GUI(s), or otherwise visualization(s) may be rendered or implemented via the app configured to execute on a user computer device (e.g., user computing device 111*c*1 as described herein). In such embodiments, the app may be configured to receive and render the shave data on a display screen of the user computing device (e.g., user computing device 111*c*1).

In some embodiments, the indication may be further based on post processing data generated, e.g., by processor 156, via application of one or more of signal smoothing, a hysteresis analysis, a time delay analysis, or signal processing to the comparison data.

In some embodiments, the indication provided by the communication device is customizable by the user. For example, in various embodiments, the communication device is configured to provide the indication directly to the user or, additionally or alternatively, to another device (e.g., user computing device 111*c*1 as illustrated in FIG. 2 herein). The user may customize which, if any, of these ways the indication is provided.

In the embodiment of FIG. 1, processor 156 is illustrated as onboard grooming device 150. However, processor 156 may be configured either onboard and/or offboard the grooming device. For example, in some embodiments, comparing of the one or more subsequent datasets to a unique threshold value of a user to determine comparison data, as described above, may be implemented by an onboard processor onboard the grooming device (e.g., grooming device 150).

Additionally, or alternatively, comparing of the one or more subsequent datasets to the unique threshold value of the user to determine comparison data, as described above, may be implemented by an offboard processor (e.g., a processor of server(s) 102 as described for FIG. 2 herein) communicatively coupled to the grooming device (e.g., grooming device 150) via a wired or wireless computer network. Still further, in some embodiments, the offboard processor may be configured to execute as part of at least one of a base station of the grooming device (e.g., grooming device 150), a mobile device (e.g., user computing device 111*c*1 as illustrated in FIG. 2 herein), or a remote computing device (e.g., server(s) 102, which may be cloud based servers a described herein). In such embodiments, grooming device 150 may transmit and/or receive, e.g., via its communication device and/or processor, shave data and/or datasets to a computer network device 160, e.g., which may be a router, Wi-Fi router, hub, or switch, capable of sending and receiving packet data on a computer network, e.g., to server(s) 102 as described for FIG. 2 herein.

FIG. 2 illustrates a further example of a sensor-based shaving system 200, having multiple grooming devices, and configured to analyze a user shave event(s) for determining respective unique threshold value(s) for respective users in accordance with various embodiments disclosed herein. For example, in the embodiment of FIG. 2, sensor-based shaving system 200 includes grooming device 150 as described for FIG. 1. Sensor-based shaving system 200 further includes a second grooming device 170. Grooming device 170 is configured the same or similarly as described herein for FIG. 1. For example, grooming device 170 is configured to communicatively coupled to a computer network device 180, e.g., which may be a router, Wi-Fi router, hub, or switch, cable of sending and receiving packet data on a computer network (e.g., computer network 120), e.g., to server(s) 102 as shown for FIG. 2.

In the example embodiment of FIG. 2, sensor-based shaving system 200 includes server(s) 102, which may comprise one or more computer servers. In various embodiments, server(s) 102 comprise multiple servers, which may comprise multiple, redundant, or replicated servers as part of a server farm. In still further embodiments, server(s) 102 may be implemented as cloud-based servers, such as a cloud-based computing platform. For example, server(s) 102 may be any one or more cloud-based platform(s) such as MICROSOFT AZURE, AMAZON AWS, or the like. Server(s) 102 may include one or more processor(s) 104 as well as one or more computer memories 106.

Memorie(s) 106 may include one or more forms of volatile and/or non-volatile, fixed and/or removable memory, such as read-only memory (ROM), electronic programmable read-only memory (EPROM), random access memory (RAM), erasable electronic programmable read-only memory (EEPROM), and/or other hard drives, flash memory, MicroSD cards, and others. The memorie(s) 106 may store an operating system (OS) (e.g., Microsoft Windows, Linux, UNIX, etc.) capable of facilitating the functionalities, apps, methods, or other software as discussed herein. The memorie(s) 106 may also store a sensor-based learning model 108, which may be an artificial intelligence based model, such as a machine learning model, trained on shave data or datasets, as described herein. Additionally, or alternatively, the sensor-based learning model 108 may also be stored in database 105, which is accessible or otherwise communicatively coupled to server(s) 102. The memories 106 may also store machine readable instructions, including any of one or more application(s), one or more software component(s), and/or one or more application programming interfaces (APIs), which may be implemented to facilitate or perform the features, functions, or other disclosure described herein, such as any methods, processes, elements or limitations, as illustrated, depicted, or described for the various flowcharts, illustrations, diagrams, figures, and/or other disclosures herein. For example, at least some of the applications, software components, or APIs may be, include, otherwise be part of, an imaging based machine learning model or component, such as the sensor-based learning model 108, where each may be configured to facilitate their various functionalities discussed herein. It should be appreciated that one or more other applications may be envisioned and that are executed by the processor(s) 104.

The processor(s) 104 may be connected to the memories 106 via a computer bus responsible for transmitting electronic data, data packets, or otherwise electronic signals to and from the processor(s) 104 and memories 106 in order to implement or perform the machine readable instructions, methods, processes, elements or limitations, as illustrated, depicted, or described for the various flowcharts, illustrations, diagrams, figures, and/or other disclosures herein.

The processor(s) 104 may interface with the memory 106 via the computer bus to execute the operating system (OS). The processor(s) 104 may also interface with the memory 106 via the computer bus to create, read, update, delete, or otherwise access or interact with the data stored in the memories 106 and/or the database 105 (e.g., a relational database, such as Oracle, DB2, MySQL, or a NoSQL based database, such as MongoDB). The data stored in the memories 106 and/or the database 105 may include all or part of any of the data or information described herein, including, for example, shave data or datasets (e.g., first or subsequent datasets regarding shave data) or other information of the user, user profile data including demographic, age, race, skin type, or the like, and/or previous shave data associated with one or more shaving devices or implements. For example, in some embodiments, user profile data may be obtained via a questionnaire in a software app associated with the grooming device 150, e.g., as described herein for FIG. 6.

In some embodiments, unique threshold values or datasets between different users or groups of users may be compared. For example, in an embodiment where grooming device 150 was of a first user, and grooming device 170 was of a second user, then unique threshold values or datasets of the first user and the second user may be compared, and may be used, e.g., to generate or update a starting or common baseline for a new user or for new grooming devices.

Additionally, or alternatively, calibration data may be collected from multiple grooming devices (e.g., grooming device 150 and grooming device 170) to compare data usage between users. Such calibration data may be used, e.g., to generate or update a starting or common baseline for a new user or to calibrate a new grooming device. In one embodiment, calibration data may be captured during production and compared. In such embodiments, the calibration data, as collected from multiple user grooming devices (e.g., grooming device 150 and grooming device 170) may be used to create a standardized reference point (i.e., a calibration value) for each grooming device. In such embodiments, a known load input is created for the shave event sensor. Output data of the sensor may be determined for a given grooming device. A calibration value may be used to convert raw sensor values, as output from a sensor of a grooming device, into actual or (i.e., real world measurable) pressure or load values. The actual pressure or load values may then be used to compare datasets from different devices (e.g., of difference users, such as grooming device 150 and grooming device 170) against each other. In some embodiments, users may receive a communication (e.g., from server(s) 102) regarding how their personal threshold compares to other user(s), including a wider population of user(s) in various regions. For example, after performing an analysis of a first or subsequent dataset, server(s) 102 may communicate the analysis to a user to let the user know how their behavior compares to either specific individuals, or an overall population, or combinations thereof.

In further embodiments, profile data may be loaded from a previous device, e.g., where a user purchases a same type, different, otherwise new grooming device. In such embodiments, a same type, different, otherwise new grooming device may receive previously collected user profile data for a previous or different grooming device. The same type, different, otherwise new grooming device may be then configured with the unique threshold value based on the user profile data in order to setup the same type, different, otherwise new grooming device to behave similarly to the previous or different grooming device.

In some embodiments, a translation of a previous unique threshold value may be implemented to transition to a new threshold if old and new devices have hardware differences. In such embodiments, previously collected user profile data of an old grooming device may be adjusted to match characteristics (e.g., hardware characteristics) of a new grooming device.

With reference to FIG. 2, server(s) 102 may further include a communication component configured to communicate (e.g., send and receive) data via one or more external/network port(s) to one or more networks or local terminals, such as computer network 120 and/or terminal 109 (for rendering or visualizing) described herein. In some embodiments, 15826Q server(s) 102 may include a client-server platform technology such as ASP.NET, Java J2EE, Ruby on Rails, Node.js, a web service or online API, responsive for receiving and responding to electronic requests. The server(s) 102 may implement the client-server platform technology that may interact, via the computer bus, with the memories(s) 106 (including the applications(s), component(s), API(s), data, etc. stored therein) and/or database 105 to implement or perform the machine readable instructions, methods, processes, elements or limitations, as illustrated, depicted, or described for the various flowcharts, illustrations, diagrams, figures, and/or other disclosure herein. According to some embodiments, the server(s) 102 may include, or interact with, one or more transceivers (e.g., WWAN, WLAN, and/or WPAN transceivers) functioning in accordance with IEEE standards, 3GPP standards, or other standards, and that may be used in receipt and transmission of data via external/network ports connected to computer network 120. In some embodiments, computer network 120 may comprise a private network or local area network (LAN). Additionally, or alternatively, computer network 120 may comprise a public network such as the Internet.

Server(s) 102 may further include or implement an operator interface configured to present information to an administrator or operator and/or receive inputs from the administrator or operator. As shown in FIG. 2, an operator interface may provide a display screen (e.g., via terminal 109). Server(s) 102 may also provide I/O components (e.g., ports, capacitive or resistive touch sensitive input panels, keys, buttons, lights, LEDs), which may be directly accessible via or attached to server(s) 102 or may be indirectly accessible via or attached to terminal 109.

According to some embodiments, an administrator or operator may access the server 102 via terminal 109 to review information, make changes, input training data, and/or perform other functions.

As described above herein, in some embodiments, server(s) 102 may perform the functionalities as discussed herein as part of a "cloud" network or may otherwise communicate with other hardware or software components within the cloud to send, retrieve, or otherwise analyze data or information described herein.

In general, a computer program or computer based product, application, or code (e.g., the model(s), such as AI models, or other computing instructions described herein) may be stored on a computer usable storage medium, or tangible, non-transitory computer-readable medium (e.g., standard random access memory (RAM), an optical disc, a universal serial bus (USB) drive, or the like) having such computer-readable program code or computer instructions embodied therein, wherein the computer-readable program code or computer instructions may be installed on or otherwise adapted to be executed by the processor(s) 104 (e.g., working in connection with the respective operating system in memories 106) to facilitate, implement, or perform the machine readable instructions, methods, processes, elements or limitations, as illustrated, depicted, or described for the various flowcharts, illustrations, diagrams, figures, and/or other disclosure herein. In this regard, the program code may be implemented in any desired program language, and may be implemented as machine code, assembly code, byte code, interpretable source code or the like (e.g., via Golang, Python, C, C++, C#, Objective-C, Java, Scala, ActionScript, JavaScript, HTML, CSS, XML, etc.).

As shown in FIG. 2, server(s) 102 are communicatively connected, via computer network 120 to grooming device 150 and grooming device 170. Each of grooming device 150 and grooming device 170 may connect to their computer network devices 160 180, respectively, as described herein, e.g., which may be a router, Wi-Fi router, hub, or switch, capable of sending and receiving packet data on a computer network (e.g., computer network 120), e.g., to server(s) 102. In particular, computer network devices 160 and 180 may comprise routers, wireless switches, or other such wireless connection points communicating with user computing devices (e.g., user computing device 111*c*1 and user computing device 112*c*1) via wireless communications 122 based on any one or more of various wireless standards, including by non-limiting example, IEEE 802.11a/b/c/g (WIFI), the BLUETOOTH standard, or the like.

Server(s) 102 are also communicatively connected, via computer network 120, to user computing devices, including user computing device 111*c*1 and user computing device 112*c*1, via base stations 111*b* and 112*b*. Base stations 111*b* and 112*b* may comprise cellular base stations, such as cell towers, communicating to user computing devices (e.g., user computing device 111*c*1 and user computing device 112*c*1), via wireless communications 121 based on any one or more of various mobile phone standards, including NMT, GSM, CDMA, UMMTS, LTE, 5G, or the like.

User computing devices, including user computing device 111*c*1 and user computing device 112*c*1 may connect to grooming device 150 and grooming device 170 either directly or via computer network devices 160 and 180. Additionally, or alternatively, grooming device 150 and grooming device 170 may connect to server(s) 102 over computer network 120 via either base stations 111*b* or 112*b* and/or computer network devices 160 and 180.

User computing devices (e.g., user computing device 111*c*1 and user computing device 112*c*1) may comprise mobile devices and/or client devices for accessing and/or communications with server(s) 102. In various embodiments, user computing devices (e.g., user computing device 111*c*1 and user computing device 112*c*1) may comprise a cellular phone, a mobile phone, a tablet device, a personal data assistance (PDA), or the like, including, by non-limiting example, an APPLE iPhone or iPad device or a GOOGLE ANDROID based mobile phone or table. In addition, the user computing devices (e.g., user computing device 111*c*1 and user computing device 112*c*1) may implement or execute an operating system (OS) or mobile platform such as Apple's iOS and/or Google's Android operating system. Any of the user computing devices (e.g., user computing device 111*c*1 and user computing device 112*c*1) may comprise one or more processors and/or one or more memories for storing, implementing, or executing computing instructions or code, e.g., a mobile application, as described in various embodiments herein.

User computing devices (e.g., user computing device 111*c*1 and user computing device 112*c*1) may comprise a wireless transceiver to receive and transmit wireless communications 121 and/or 122 to and from base stations 111*b* and/or 112*b*. In this way, shave data and/or datasets may be transmitted via computer network 120 to server(s) 102 for determining unique threshold value(s) and/or training of model(s) as describe herein.

User computing devices (e.g., user computing device 111*c*1 and user computing device 112*c*1) may include a display screen for displaying graphics, images, text, data, interfaces, graphic user interfaces (GUI), and/or such visualizations or information as described herein.

Figure 3:
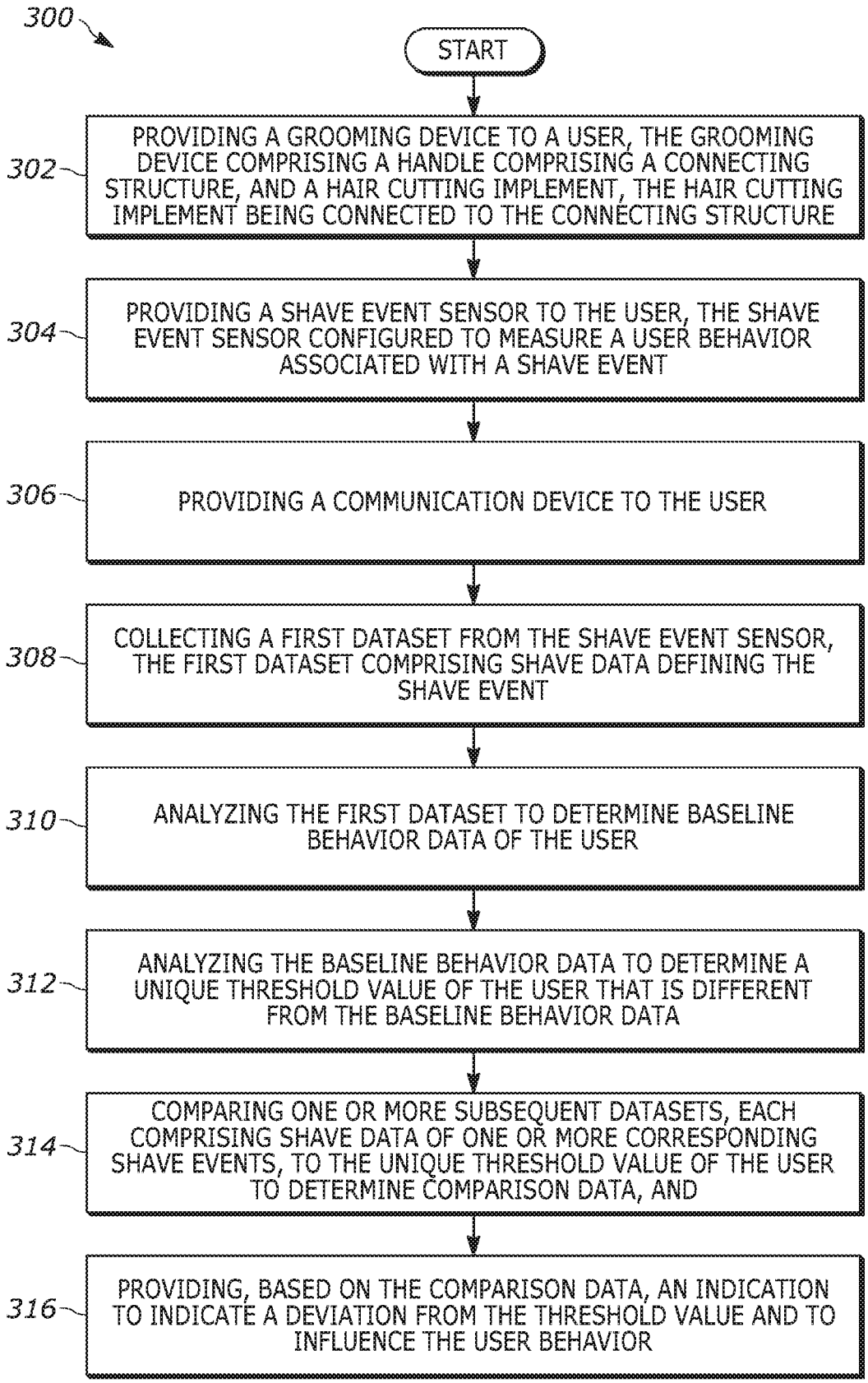
FIG. 3 illustrates a diagram of an example sensor-based shaving method of analyzing a user's shave event for determining a unique threshold value of the user in accordance with various embodiments disclosed herein.

FIG. 3 illustrates a diagram of an example sensor-based shaving method 300 of analyzing a user's shave event for determining a unique threshold value of the user in accordance with various embodiments disclosed herein. At block 302, method 300 comprises providing a grooming device (e.g., grooming device 150) to a user, the grooming device comprising (i) a handle comprising a connecting structure, and a hair cutting implement, the hair cutting implement being connected to the connecting structure.

At block 304, method 300 further comprises providing a shave event sensor (e.g., shave event sensor 154) to the user. The shave event sensor is configured to measure a user behavior associated with a shave event. For example, as shown for FIG. 1, a grooming device may comprise a razor and a load sensor (e.g., shave event sensor 154), wireless internet connectivity (e.g., via computer network device 160), an onboard microprocessor (e.g., processor 156), and an indication or indicator (e.g., an RGB feedback LED), such as indication 152.

At block 306, method 300 further comprises providing a communication device to the user. The communication device may comprise any one or more of a wired connection or a wireless connection, including a Bluetooth connection, a Wi-Fi connection, a cellular connection, and/or an infrared connection. In various embodiments, the communication device communicatively coupled to the grooming device (e.g., grooming device 150), a charger of the grooming device, a base station of the grooming device, or a computing device (e.g., user computing device 111*c*1 as illustrated in FIG. 2 herein) having a processor executing a digital application.

At block 308, method 300 further comprises collecting a first dataset from the shave event sensor, the first dataset comprising shave data defining the shave event. In various embodiments, the shave data and/or dataset(s) (e.g., first or subsequent datasets) may be transmitted to server(s) 102. In some embodiments, such shave data and/or datasets may be transmitted every time the grooming device (e.g., grooming device 150) is used. However, it is to be understood, that other transmission schemes, such as sample based transmission (where less than all data) is transmitted to server(s) 102 from time to time.

With reference to FIG. 3, at block 310, method 300 further comprises analyzing the first dataset to determine baseline behavior data of the user. In various embodiments, for example, server(s) 102 may receive and analyze the first dataset to determine baseline behavior data. Analysis may include identifying stroke events as load or pressure peaks above a baseline or threshold value, as described herein for FIGS. 4A, 4B, 5A, and/or 5B.

Figure 4A:
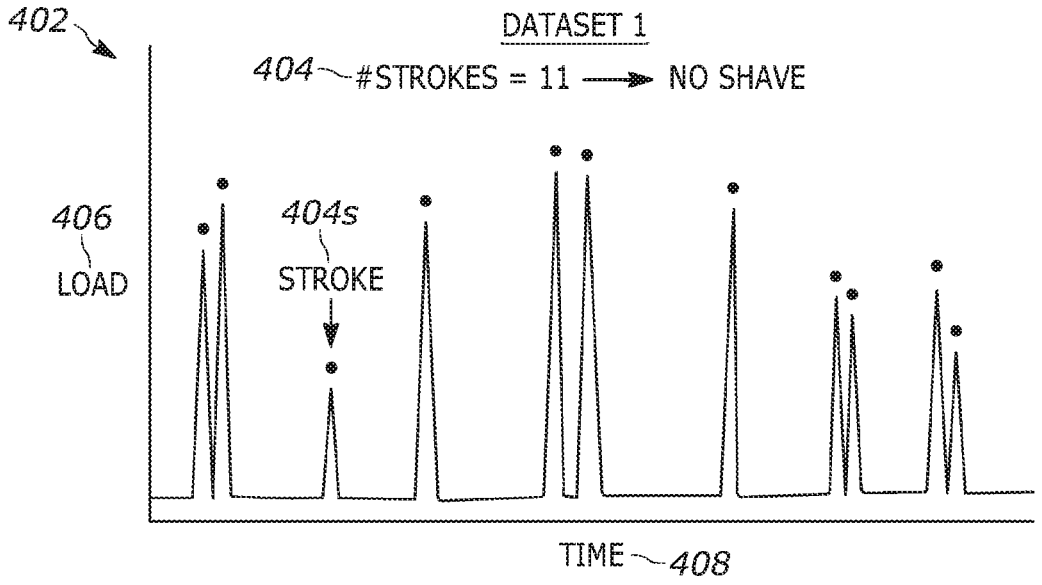
FIG. 4A illustrates a visualization of a dataset comprising shave data in accordance with various embodiments disclosed herein.

FIG. 4A illustrates a visualization of a dataset 402 (e.g., "dataset 1") comprising shave data in accordance with various embodiments disclosed herein. Dataset 402 depicts shave data as load 406 across time 408. The load measures the load or pressure applied against a user's face or skin. As shown in FIG. 4A, load 406 compared over time 408 can be used to identified strokes of a grooming device (e.g., grooming device 150) against a user's face or skin. For example, stroke 404*s* is a third stroke taken by the user with a grooming device during time 408. For example, stroke 404*s* is identifiable due to the spike in the load 406 across time 408. As shown in dataset 402, there are eleven (11) total strokes across time 408. In various embodiments, a stroke count may be used to identify a shave event (e.g., a complete shave of the face). As shown the example of FIG. 4A, if the stroke count is too low, then a "no shave" event may be detected, indicating that the user was not engaged in a shaving event during the given time 408.

Figure 4B:
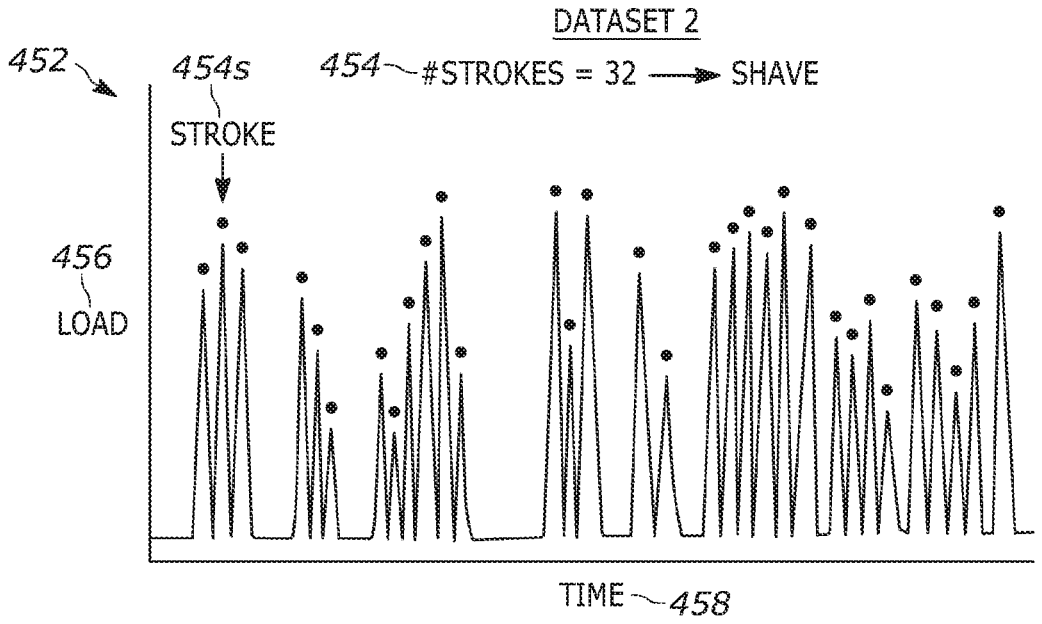
FIG. 4B illustrates a visualization of a further dataset comprising shave data of a shave event in accordance with various embodiments disclosed herein.

In various embodiments, if the stroke count exceeds a threshold then a shave event may be identified. For example, FIG. 4B illustrates a visualization of a further dataset 452 (e.g., "dataset 2") comprising shave data of a shave event in accordance with various embodiments disclosed herein. Dataset 452 depicts shave data as load 456 across time 458. The load measures the load or pressure applied against a user's face or skin. As shown in FIG. 4B, load 456 compared over time 458 can be used to identify strokes of a grooming device (e.g., grooming device 150) against a user's face or skin. For example, stroke 454*s* is a second stroke taken by the user with a grooming device during time 458. For example, stroke 454*s* is identifiable due to the spike in the load 456 across time 458. As shown in dataset 452, there are thirty-two (32) total strokes across time 458. In various embodiments, a stroke count may be used to identify a shave event (e.g., a complete shave of the face). As shown the example of FIG. 4B, if the stroke count exceeds a given stroke count threshold, then a "shave" event may be detected, indicating that the user was engaged in a shaving event during the given time 408. For example, a stroke count threshold may be set to a value of thirty (30), where, in the example of FIG. 4B indicates that a shave event occurred given that the user's stroke count was above the stroke count threshold.

With reference to FIG. 3, at block 312, method 300 further comprises analyzing the baseline behavior data to determine a unique threshold value of the user. The unique threshold value is different from the baseline behavior data. In various embodiments, determining a user's unique threshold value comprises having the user complete a first shave, referred to herein as a "diagnostic shave." In some embodiments, during the diagnostic shave, a grooming device (e.g., grooming device 150) does not provide an indication (e.g., indication 152) of load to the user. For example, in such embodiments, there is no load feedback (e.g., green/red lights) during this shave. Instead, for example, grooming device (e.g., grooming device 150) may simply show a neutral color (e.g., blue) to indicate that the grooming device (e.g., grooming device 150) is active and/or learning. In some embodiments, user profile data may be collected (e.g., via grooming device 150 in communication with server(s) 102) for analyzing the user profile data with the baseline behavior data to determine the unique threshold value of the user. Such user profile data may include demographic data (e.g., age, skin type, or the like), and may be used in combination with data determined from a diagnostic shave to determine the unique threshold value.

Figure 6:
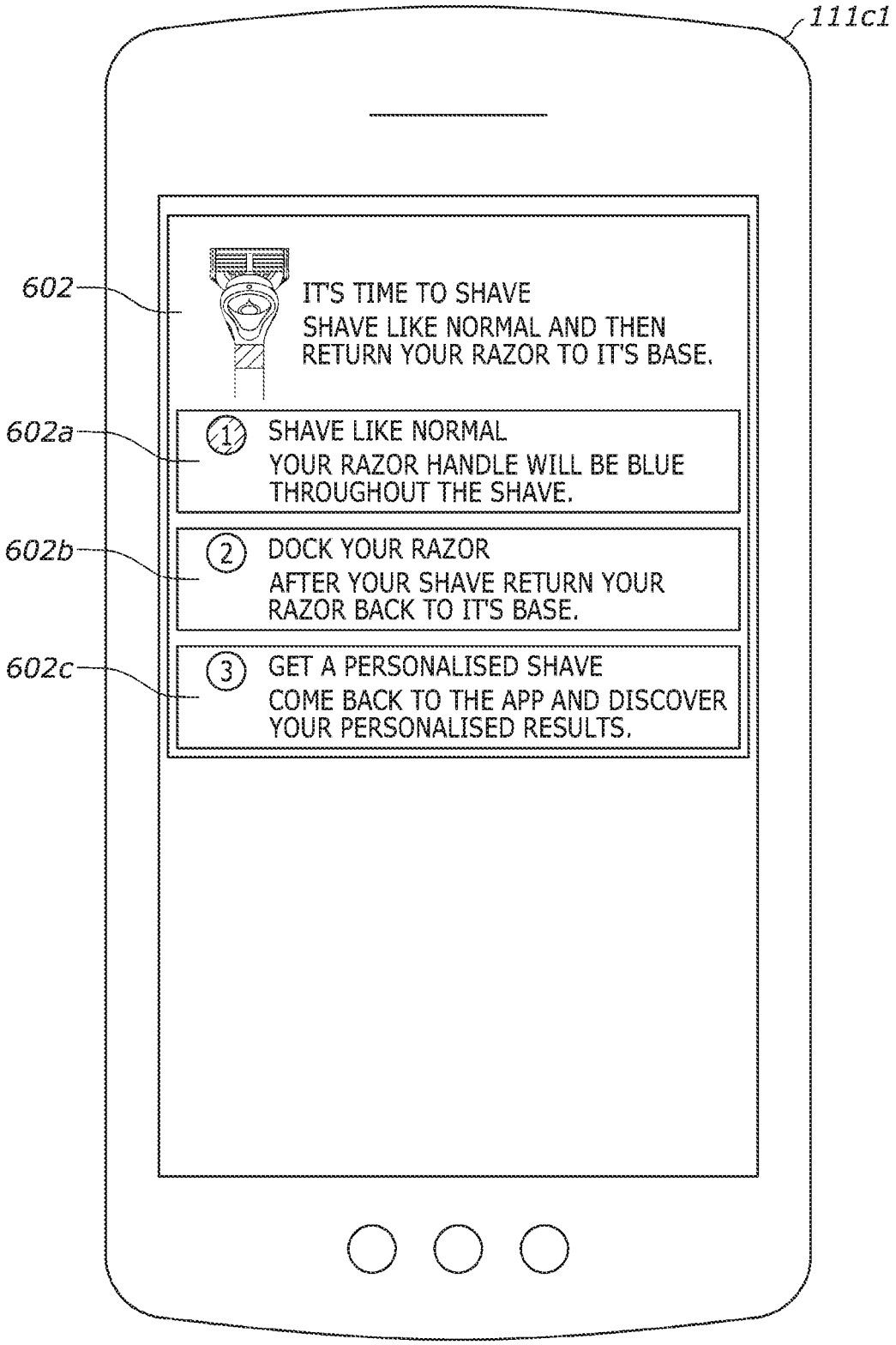
FIG. 6 illustrates an example display or user interface of an application (app) as displayed on a user computing device for initiating a diagnostic shave of a grooming device in accordance with various embodiments disclosed herein.

Implementation of a diagnostic shave may be communicated to the user by a software application (app), e.g., as implemented on a user computing device. For example, FIG. 6 illustrates an example display or user interface 602 of an app as displayed on a user computing device 111*c*1 (e.g., of FIG. 1) for initiating a diagnostic shave of a grooming device in accordance with various embodiments disclosed herein. User computing device 111*c*1 may be communicatively coupled to a grooming device (e.g., grooming device 150) as described herein for FIGS. 1 and 2, and configured to implement the app to instruct a user as to setup or initiation of the grooming device (e.g., grooming device 150). As shown on user interface 602, a user may be instructed to shave like normal (602*a*) and then return the razor back to its base (602*b*). The use may then be instructed that personalized results (e.g., unique threshold value) may be available at a later time (603*c*), e.g., following analysis of the shaving data and/or datasets.

In some embodiments, a diagnostic shave is used to configure or setup a grooming device (e.g., grooming device 150) for a user during first use. For example, when a new grooming device is acquired by a user, an out-of-box or factory default status may be detected by the grooming device software detecting that a diagnostic mode flag is set in the memory of the grooming device 150 and/or at the server(s) 102 for a given grooming device. Such diagnostic mode flag could trigger the grooming device 150 to set the indicator (e.g., indication 152) of the grooming device to a diagnostic indicator color (e.g., blue), and then implement a diagnostic shave.

In various embodiments, server(s) 102 may receive a dataset of a grooming device (e.g., grooming device 150) and detect that the dataset is a first dataset where the diagnostic mode flag is set to a value of "true." Server(s) 102 may then analyze the first dataset to determine a unique threshold value for the user as described herein.

In some embodiments, a unique threshold value may be determined by measuring peak height for one or more given strokes in a dataset of shave data. For example, in the embodiment of FIG. 4B, each of stroke 454*s* (and other strokes identifiable therein) have measurable peak heights. The unique threshold value may be determined by taking an average, median, or other statistical analysis measurable peak heights.

Figure 5A:
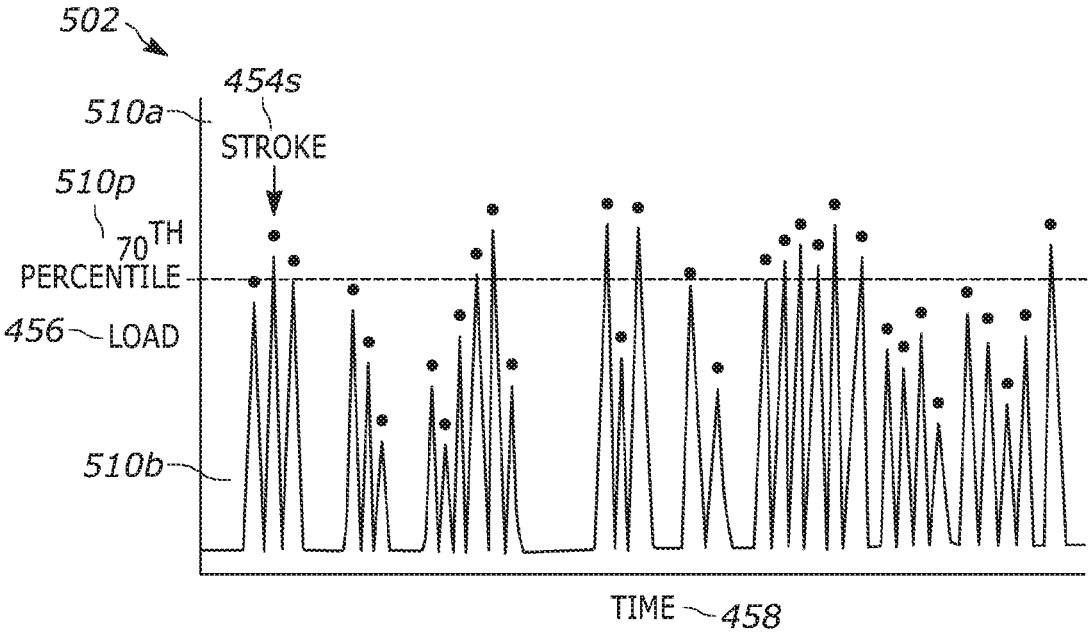
FIG. 5A illustrates a visualization of a dataset of baseline behavior data of FIG. 4B to determine a unique threshold value of a user.

FIG. 5A illustrates a visualization of a dataset 502 of baseline behavior data of FIG. 4B to determine a unique threshold value of a user, in accordance with various embodiments disclosed herein. In the example of FIG. 5A, dataset 502 corresponds to dataset 452 of FIG. 4B. In the embodiment of FIG. 5A, unique threshold value 510*p* is a percentage based threshold value. It is to be understood, however, that other types of thresholds (e.g., numerical or decimal) may be used as well. For the embodiment of FIG. 5A, unique threshold value 510*p* is a 70th percentile of the peak values for each of the strokes detected in dataset 502. Unique threshold value 510*p* is calculated (e.g., by server(s) 102) so that 30% of the peaks are above and 70% below unique threshold value 510*p*. In the example of FIG. 5A, an initial value comprising a 70:30 split based on the assumption that a $70^{th}$ percentile threshold value will encourage a user to eliminate his or her higher load strokes (e.g., those above the 70 percentile) while also being an achievable shift from the user's standard behavior.

In the embodiment of FIG. 5A, unique threshold value 510*p* having a 70th percentile value, as calculated (e.g., by server(s) 102) based on the stroke data of dataset 502, is set as the user's unique threshold value. Server(s) 102 may communicate the unique threshold value to the grooming device (e.g., grooming device 150) via computer network 120 as described herein. In addition, in various embodiments, the diagnostic mode flag (e.g., at the grooming device 150 and/or server(s) 102) may be set to a value of "false,"

which will allow grooming device 150 to operate so as to provide an indication as active feedback to the user (e.g., green/red feedback colors) via indication 152.

Figure 7:
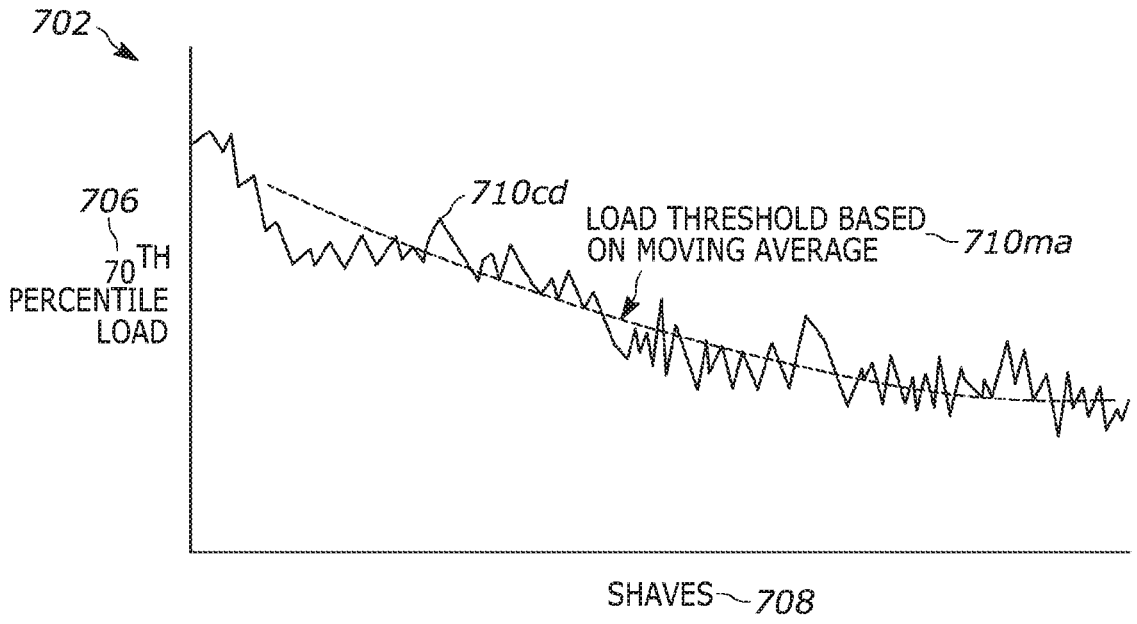
FIG. 7 illustrates a visualization of a dataset having threshold percentile load adjusted over time based on shaving data, in accordance with various embodiments disclosed herein.

In some embodiments, a user's unique threshold value may be adjusted over time based on ongoing shave data so that the grooming device or otherwise sensor-based shaving is self-learning. For example, FIG. 7 illustrates a visualization of a dataset 702 having threshold percentile load 706 adjusted over time based on shaving data 708, in accordance with various embodiments disclosed herein. In the embodiment of FIG. 7, a grooming device (e.g., grooming device 150), in communication with server(s) 102 analyzing shaving data 708 (e.g., shave events, strokes, etc.), could learn a user's behavior as it changes over time. In such embodiments, server(s) 102 could adjust (and retransmit to the grooming device) the user's unique threshold value, as adjusted or otherwise updated. For example, once a user has learned to reduce their load by an initial 30% amount, then server(s) 102 could determine or generate new baseline values, and related new unique threshold values as adjusted, to encourage a user to continue to reduce his or her load for further irritation reduction. Such self-learning could extend the benefit of the grooming device 150 to the user. A unique threshold value may be based on various dataset types and amounts, e.g., including an entire cumulative dataset for the user or on the most recent data only, such as a rolling average of the last 10 shave events. For example, as shown for FIG. 7, a unique threshold value 710*ma* is based on the moving average of cumulative datasets 710*cd* across shaving data 708.

Additionally, or alternatively, grooming device 150 and/or server(s) 102 may implement self-learning via an artificial intelligence or machine learning model. In such embodiments, a sensor-based learning model (e.g., sensor-based learning model 108 as described for FIG. 2) may be communicatively coupled to the shave event sensor of a grooming device (e.g., grooming device 150). A sensor-based learning model may be trained with the data of at least a first dataset (as generated via data of the shave event sensor). In such embodiments, the sensor-based learning model is configured to analyze the one or more subsequent datasets to adjust the unique threshold value of the user.

In various embodiments, a machine learning imaging model, as described herein (e.g. sensor-based learning model 108), may be trained using a supervised or unsupervised machine learning program or algorithm. The machine learning program or algorithm may employ a neural network, which may be a convolutional neural network, a deep learning neural network, or a combined learning module or program that learns in one or more features or feature datasets (e.g., pressure or load data of any of datasets 402, 452, and/or 502 as described herein). The machine learning programs or algorithms may also include natural language processing, semantic analysis, automatic reasoning, regression analysis, support vector machine (SVM) analysis, decision tree analysis, random forest analysis, K-Nearest neighbor analysis, naïve B ayes analysis, clustering, reinforcement learning, and/or other machine learning algorithms and/or techniques. In some embodiments, the artificial intelligence and/or machine learning based algorithms may be included as a library or package executed on imaging server(s) 102. For example, libraries may include the TENSORFLOW based library, the PYTORCH library, and/or the SCIKIT-LEARN Python library.

Machine learning may involve identifying and recognizing patterns in existing data (such as training a model based on pressure or load data of a user when shaving with a grooming device) in order to facilitate making predictions or identification for subsequent data (such as using the model to generate a unique threshold value for the user based on first datasets and/or subsequent datasets).

Machine learning model(s), such as the sensor-based learning model described herein for some embodiments, may be created and trained based upon example data (e.g., "training data" and related load data) inputs or data (which may be termed "features" and "labels") in order to make valid and reliable predictions for new inputs, such as testing level or production level data or inputs. In supervised machine learning, a machine learning program operating on a server, computing device, or otherwise processor(s), may be provided with example inputs (e.g., "features") and their associated, or observed, outputs (e.g., "labels") in order for the machine learning program or algorithm to determine or discover rules, relationships, patterns, or otherwise machine learning "models" that map such inputs (e.g., "features") to the outputs (e.g., labels), for example, by determining and/or assigning weights or other metrics to the model across its various feature categories. Such rules, relationships, or otherwise models may then be provided subsequent inputs in order for the model, executing on the server, computing device, or otherwise processor(s), to predict, based on the discovered rules, relationships, or model, an expected output.

In unsupervised machine learning, the server, computing device, or otherwise processor(s), may be required to find its own structure in unlabeled example inputs, where, for example multiple training iterations are executed by the server, computing device, or otherwise processor(s) to train multiple generations of models until a satisfactory model, e.g., a model that provides sufficient prediction accuracy when given test level or production level data or inputs, is generated. The disclosures herein may use one or both of such supervised or unsupervised machine learning techniques.

For example, server(s) 102 may receive load data (e.g., of datasets 402, 452, and/or 502) and train a sensor-based learning model to generate a unique threshold value of a user. In some embodiments, the sensor-based learning model may be retrained upon an occurrence of a pre-determined trigger situation (e.g., such as elapsed amount of time, detection of first use, or after an upgrade to the software of the grooming device). In some embodiments, the sensor-based learning model 108 may be further trained with user profile data in combination with the load or pressure data, where the user profile data adjusts the output of the sensor-based learning model based on the user's responses or input as to the user profile data.

Additionally, or alternatively, a user can manually adjust a unique threshold value up or down, e.g., based on their own personal preference or goals. In such embodiments, a unique threshold value is configured so to be adjustable by the user. Such embodiments allow the user to adjust the unique threshold value by adjusting different threshold percentage values or by setting different modes. For example, while a self-learning model, as described herein, may be used to set a unique threshold value, measuring load correctly for most users, a user may want to manually adjust their own unique threshold value up or down. In such embodiments, a user may select one or more modes (e.g. high mode, medium mode, and/or low mode) to adjust their threshold. The selection may be made, e.g., via a software application (app) executing on a user computing device (e.g., as shown and described for FIG. 6 herein). Additionally, user profile data may be acquired for the user e.g., via a software application (app) executing on a user computing device. This user profile data may then be used during the calculation of the unique threshold value to help determine the user's "mode" without the user having to explicitly select the mode manually.

With reference to FIG. 3, at block 314, method 300 further comprises comparing one or more subsequent datasets, each comprising shave data of one or more corresponding shave events, to the unique threshold value of the user to determine comparison data. For example, any one or more of datasets 402, 452 and/or 502 are representative of a subsequent dataset(s). Subsequent data(s) refer to datasets capture after the first dataset and/or after the diagnostic shave, or its related setup, has been captured or completed, as described herein. In some embodiments, subsequent dataset(s) may be analyzed (e.g., by server(s) 102) to determine one or more types of shave strokes. A type of shave stroke can comprise a direction, a body location (e.g., on the user's body), or a geographical location of a shave stroke (e.g., based on GPS data).

In some embodiments, different unique threshold values may be determined for different stroke types. For example, in such embodiments, server(s) 102 may compare different ones of one or more types of shave strokes to each of various unique threshold values, e.g., a first unique threshold value and a second unique threshold value. In such embodiments, the first unique threshold value may be different from the second unique threshold value. Such embodiments, would provide different thresholds for different scenarios. As an example, this can include a lower load threshold for up-strokes versus down-strokes, and/or a lower threshold for neck strokes versus face strokes. Different thresholds for different uses allow for optimization balance between closeness of shave and irritation by indicating to the user to press harder in face or skin areas (or related shaving scenarios) with a low risk of irritation, but at the same time encouraging the user to be more careful (i.e., decrease pressure or load) in face or skin areas (or related shaving scenarios) with a high risk.

Additionally, or alternatively, multiple thresholds could be set for a grooming device (e.g., grooming device 150) relative to a same average peak value of the shave data of the diagnostic shave as described herein. Additionally, or alternatively, server(s) 102 may implement a diagnostic shave offline to classify individual strokes (e.g., of one or more of datasets 402, 452, and/or 502) into groups. Server(s) 102 may then set one or more unique threshold value(s) based on an average peak value of each group. In some embodiments, live location data and/or direction aware load feedback data may be generated by the grooming device (e.g., grooming device 150) by analyzing each stroke dynamically to determine the location/direction. Such live location data and/or direction aware load feedback may be used by the grooming device 150 to switch or apply the relevant unique threshold value dynamically based on the grooming device's location relevant to the user's face, neck, and/or body.

Additionally, or alternatively, in some embodiments, server(s) 102 may analyze the baseline behavior data of a user (e.g., as generated for a diagnostic shave) to determine a second unique threshold value of the user. The second unique threshold value may differ from the baseline behavior data. In such embodiments, multiple thresholds (e.g., for high, medium, and/or low zones in a given dataset, such as any one of more of datasets 402, 452, and/or 502) may be generated by server(s) 102. In such embodiments, a lower unique threshold value may be set so that the grooming device (e.g., grooming device 150) shows low green when not positioned on the user's face or skin (e.g., indicating zero load) and high green when positioned on the user's face or skin (e.g. indicating below the load threshold).

Figure 5B:
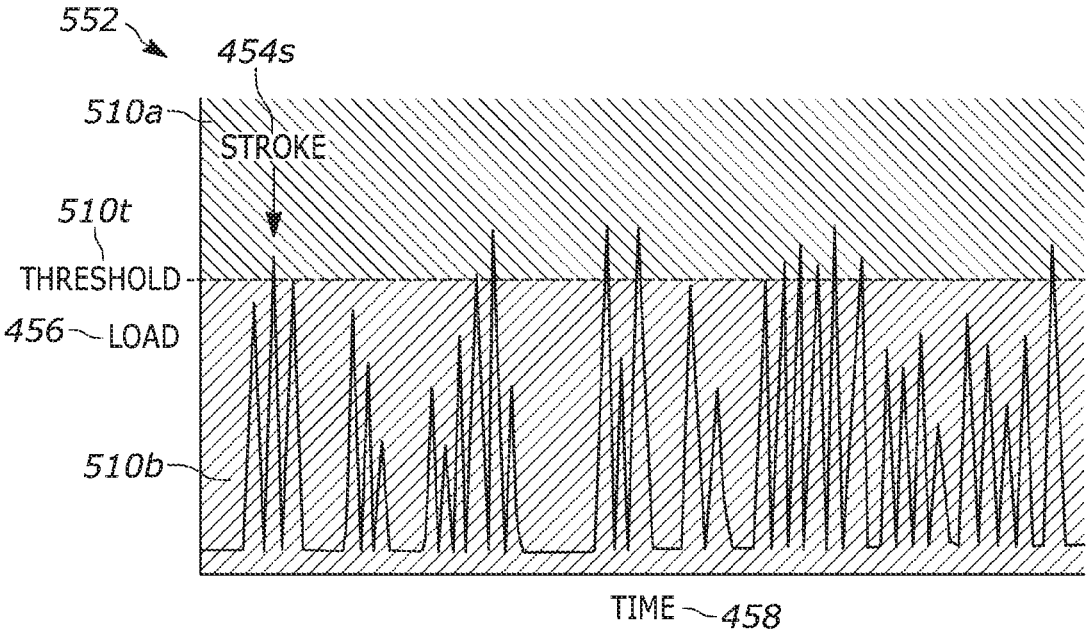
FIG. 5B illustrates a visualization of the unique threshold value of FIG. 5A with corresponding portions for shave data above the unique threshold value and shave data below the unique threshold value, in accordance with various embodiments disclosed herein.

With reference to FIG. 3, at block 316, method 300 further comprises providing, based on the comparison data, an indication to indicate a deviation from the threshold value and to influence the user behavior. One or more subsequent dataset(s), as described herein, may be compared to the user's unique threshold value to provide an indication to the user of load or pressure applied. FIG. 5B illustrates a visualization of the unique threshold value of FIG. 5A with corresponding portions for shave data above the unique threshold value and shave data below the unique threshold value, in accordance with various embodiments disclosed herein. While the embodiment of FIG. 5A indicates a unique threshold value 510*p* of the $70^{th}$ percentile, the unique threshold value may set or determined at different percentages or values. This reflected in FIG. 5B where unique threshold value 510*t* (e.g., which could range across a variety of values and types) is applied to dataset 552. Dataset 552 corresponds to each of datasets 502 and 452 as described herein. Dataset 552 additionally depicts a top portion 510*a* and a bottom portion 510*b*. Top portion 510*a* indicates a region of load data 456, as detected by shave event sensor 154, where the load data is above the unique threshold value threshold value 510*t*. When load data, as detected by shave event sensor 154, is above the unique value threshold value 510*t*, then grooming device 150 will provide an indication (e.g., indication 152) indicating to the user that the pressure or load is too great or has otherwise exceeded the current unique threshold value (e.g., unique value threshold value 510*t*). In some embodiments, the indication is a red LED light that activates on grooming device 150 as a visual indicator.

In contrast, bottom portion 510*b* indicates a region of load data 456, as detected by shave event sensor 154, where the load data is below the unique threshold value threshold value 510*t*. When load data, as detected by shave event sensor 154, is below the unique value threshold value 510*t*, then grooming device 150 will provide an indication (e.g., indication 152) indicating to the user that the pressure or load is within acceptable limits or is otherwise within or below the current unique threshold value (e.g., unique value threshold value 510*t*). In some embodiments, the indication is a green LED light that activates on grooming device 150 as a visual indicator.

In some embodiments, a user may select to re-run a diagnostic shave to update the user's unique threshold value. In such embodiments, server(s) 102 may determine, upon receiving a manual update request of the user (e.g., by the user sending the request via grooming device 150 and/or a software app associated with grooming device 150), an updated unique threshold value based on one or more subsequent datasets received by grooming device 150. For example, a user could manually re-run diagnostic shave setup every so often, e.g., every 10 shaves, to get a get an updated unique threshold value that may correspond to the user's new behavior and/or habits from previously using grooming device 150.

Additionally, or alternatively, in some embodiments, a unique threshold may be determined based on a first dataset of only a few strokes rather than a whole shave (e.g., during a first shave with grooming device 150). The grooming device 150 may then begin providing, based on the comparison data, an indication (e.g., indication 152), e.g., via the communication device, during the first shave with the grooming device 150.

Additionally, or alternatively, in some embodiments, the grooming device may begin to provide indications immediately (i.e., without having completed a diagnostic shave). In such embodiments, comparison data, as described herein, may be generated (e.g., by server(s) 102) during collection of a first dataset by comparing at least a portion of the first dataset to either a pre-determined threshold value, a threshold value manually selected by the user, a threshold calculated based on user profile data, or a threshold calculated based on datasets collected from other relevant users.

Aspects Of The Disclosure

The following aspects are provided as examples in accordance with the disclosure herein and are not intended to limit the scope of the disclosure.

1. A sensor-based shaving method of analyzing a user's shave event for determining a unique threshold value of the user, the sensor-based shaving method comprising the steps of: (a) providing a grooming device to a user, the grooming device comprising: (i) a handle comprising a connecting structure, and (ii) a hair cutting implement, the hair cutting implement being connected to the connecting structure; (b) providing a shave event sensor to the user, the shave event sensor configured to measure a user behavior associated with a shave event; (c) providing a communication device to the user; (d) collecting a first dataset from the shave event sensor, the first dataset comprising shave data defining the shave event; (e) analyzing the first dataset to determine baseline behavior data of the user; (f) analyzing the baseline behavior data to determine a unique threshold value of the user that is different from the baseline behavior data; (g) comparing one or more subsequent datasets, each comprising shave data of one or more corresponding shave events, to the unique threshold value of the user to determine comparison data, and; (h) providing, based on the comparison data, an indication to indicate a deviation from the threshold value and to influence the user behavior.

2. The sensor-based shaving method of aspect 1, wherein the shave event sensor is communicatively coupled to the grooming device, a charger of the grooming device, a base station of the grooming device, or a computing device having a processor executing a digital application.

3. The sensor-based shaving method of any one of aspects 1-2, wherein the shave event sensor comprises a displacement sensor, a load sensor, a movement sensor, an optical sensor, an audio sensor, a temperature sensor, a mechanical button, an electronic button, or a software button.

4. The sensor-based shaving method of any one of aspects 1-3, wherein the first dataset comprises data defining one or more shaving strokes, one or more shaving sessions, or one or more user inputs.

5. The sensor-based shaving method of any one of aspects 1-4, wherein the unique threshold value is a load value, a shave count, a stroke count, a stroke direction, a stroke speed, a stroke frequency, a stroke distance, a stroke duration, a shave duration, a stroke location, a shave location, a temperature value, a device parameter, a hair parameter, or a skin parameter.

6. The sensor-based method of any one of aspects 1-5, wherein the comparing of the one or more subsequent datasets to the unique threshold value of the user to determine comparison data is implemented by an offboard processor communicatively coupled to the grooming device via a wired or wireless computer network, the offboard processor configured to execute as part of at least one of: a base station of the grooming device, a mobile device, or a remote computing device.

7. The sensor-based method of any one of aspects 1-6, wherein the comparing of the one or more subsequent datasets to the unique threshold value of the user to determine comparison data is implemented by an onboard processor onboard the grooming device.

8. The sensor-based shaving method of aspect any one of aspects 1-7, wherein the baseline behavior data of the user is calculated based on a total value of the first dataset, an average value of the first dataset, a maximum value of the first dataset, a minimum value of the first dataset, an average peak value of the first dataset, a frequency of the first dataset, or an integration of the first dataset.

9. The sensor-based shaving method of aspect any one of aspects 1-8, wherein the unique threshold value of the user is calculated based an offset, a percentile, an average, or a statistical derivation from the baseline behavior data.

10. The sensor-based shaving method of aspect any one of aspects 1-9, wherein the comparison data comprises a positive value, negative value, a neutral value, an absolute value, or a relative value.

11. The sensor-based shaving method of any one of aspects 1-10 further comprising post processing data generated by the application of one or more of signal smoothing, a hysteresis analysis, a time delay analysis, or signal processing to the comparison data, wherein the indication is further based on the post processing data.

12. The sensor-based shaving method of any one of aspects 1-11, wherein the communication device is communicatively coupled to the grooming device, a charger of the grooming device, a base station of the grooming device, or a computing device having a processor executing a digital application.

13. The sensor-based shaving method of any one of aspects 1-12, wherein the indication comprises a visual indicator, a light emitting diode (LED), a vibrator, or an audio indicator.

14. The sensor-based shaving method of any one of aspects 1-13, wherein the communication device comprises a wired connection, a Bluetooth connection, a Wi-Fi connection, or an infrared connection.

15. The sensor-based shaving method of any one of aspects 1-14, wherein the communication device is configured to provide the indication directly to the user or to another device.

16. The sensor-based shaving method of any one of aspects 1-15, wherein the communication device is configured to provide the indication directly to the user, wherein a positive state is indicated via a green signal, and wherein a negative state is indicated via a red signal.

17. The sensor-based shaving method of any one of aspects 1-16, wherein the indication provided by the communication device is customizable by the user.

18. The sensor-based shaving method any one of aspects 1-17 further comprising analyzing the baseline behavior data to determine a second unique threshold value of the user, the second unique threshold value different from the baseline behavior data.

19. The sensor-based shaving method of any one of aspects 1-18, further comprising analyzing the one or more subsequent datasets to determine one or more types of shave strokes.

20. The sensor-based shaving method of aspect 19, wherein a type of shave stroke comprises a direction, a speed, a frequency, a hair cutting status, a hair hydration, a skin hydration, a blade age, a blade wear, a shave prep status, a lubrication level, a friction level, a temperature, a humidity, an overstroke status, a facial zone, a body location, a geographical location, or a local weather condition of a shave stroke.

21. The sensor-based shaving method of aspect 19 further comprising comparing different ones of the one or more types of shave strokes to each of the unique threshold value and a second unique threshold value, wherein the unique threshold value is different from the second unique threshold value.

22. The sensor-based shaving method of aspect any one of aspects 1-21, wherein the unique threshold value is adjustable by the user.

23. The sensor-based shaving method of aspect any one of aspects 1-22 further comprising determining, upon a manual update request of the user, an updated unique threshold value based on the one or more subsequent datasets.

24. The sensor-based shaving method of aspect any one of aspects 1-23 further comprising training a sensor-based learning model communicatively coupled to the shave event sensor, the sensor-based learning model trained with the data of at least the first dataset, the sensor-based learning model configured to analyze the one or more subsequent datasets to adjust the unique threshold value of the user.

25. The sensor-based shaving method of aspect 24, further comprising retraining the sensor-based learning model upon an occurrence of a pre-determined trigger situation.

26. The sensor-based shaving method of aspect 24, wherein the sensor-based learning model is further trained with user profile data.

27. The sensor-based shaving method of any one of aspects 1-26, further comprising collecting user profile data and analyzing the user profile data with the baseline behavior data to determine the unique threshold value of the user.

28. The sensor-based shaving method of any one of aspects 1-27, further comprising generating the comparison data during collection of the first dataset by comparing at least a portion of the first dataset to either a pre-determined threshold value, a threshold value manually selected by the user, or a threshold calculated based on datasets collected from other relevant users.

29. The sensor-based shaving method of aspect 28 further comprising providing, based on the comparison data, the indicator via the communication device during the collection of the first dataset.

30. The sensor-based shaving method of any one of aspects 1-29 further comprising collecting calibration data from the grooming device.

31. The sensor-based shaving method of aspect 30, further comprising comparing unique threshold values or datasets between different users or groups of users.

32. The sensor-based shaving method of any one of aspects 1-31, further comprising receiving previously collected user profile data for a different grooming device, and configuring the grooming device with the unique threshold value based on the user profile data.

33. The sensor-based shaving method of aspect 32, further comprising adjusting the previously collected user profile data to match characteristics of the grooming device, wherein the grooming device is a new device.

34. The sensor-based shaving method of any one of aspects 1-33, wherein the grooming device comprises at least one of an electric shaver, a shaving razor, or an epilator.

35. A sensor-based shaving system configured to analyze a user's shave event for determining a unique threshold value of the user, the sensor-based shaving system comprising: a grooming device having (i) a handle comprising a connecting structure, and (ii) a hair cutting implement, the hair cutting implement being connected to the connecting structure; a shave event sensor configured to measure a user behavior associated with a shave event of a user; a communication device; and a processor, configured onboard or offboard the grooming device, and communicatively coupled to the shave event sensor and the communication device, wherein the processor is configured to execute computing instructions stored on a memory communicatively coupled to the processor, the instructions causing the processor to: collect a first dataset from the shave event sensor, the first dataset comprising shave data defining the shave event, analyze the first dataset to determine baseline behavior data of the user, analyze the baseline behavior data to determine a unique threshold value of the user that is different from the baseline behavior data, compare one or more subsequent datasets, each comprising shave data of one or more corresponding shave events, to the unique threshold value of the user to determine comparison data, and, provide, based on the comparison data, an indication to indicate a deviation from the threshold value and to influence the user behavior.

Additional Considerations

Although the disclosure herein sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

The following additional considerations apply to the foregoing discussion. Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Additionally, certain embodiments are described herein as including logic or a number of routines, subroutines, applications, or instructions. These may constitute either software (e.g., code embodied on a machine-readable medium or in a transmission signal) or hardware. In hardware, the routines, etc., are tangible units capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as a hardware module that operates to perform certain operations as described herein.

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods or routines described herein may be at least partially processor-implemented. For example, at least some of the operations of a method may be performed by one or more processors or processor-implemented hardware modules. The performance of certain of the operations may be distributed among the one or more processors, not only residing within a single machine, but deployed across a number of machines. In some example embodiments, the processor or processors may be located in a single location, while in other embodiments the processors may be distributed across a number of locations.

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other embodiments, the one or more processors or processor-implemented modules may be distributed across a number of geographic locations.

This detailed description is to be construed as exemplary only and does not describe every possible embodiment, as describing every possible embodiment would be impractical, if not impossible. A person of ordinary skill in the art may implement numerous alternate embodiments, using either current technology or technology developed after the filing date of this application.

Those of ordinary skill in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s). The systems and methods described herein are directed to an improvement to computer functionality, and improve the functioning of conventional computers.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A sensor-based shaving method of analyzing a user's shave event for determining a unique threshold value of the user, the sensor-based shaving method comprising the steps of:

a. providing a grooming device to a user, the grooming device comprising:
   i. a handle comprising a connecting structure, and
   ii. a hair cutting implement, the hair cutting implement being connected to the connecting structure;
b. providing a shave event sensor to the user, the shave event sensor coupled to the grooming device configured to measure a user behavior associated with a shave event;
c. providing a communication device communicatively coupled to the grooming device configured to communicate the measured user behavior associated with a shave event;
d. providing a processor communicatively coupled to the shave event sensor and/or communication device configured to complete the steps of:
   i. collect a first dataset from the shave event sensor, the first dataset comprising shave data defining the shave event;
   ii. analyze the first dataset to determine baseline behavior data of the user;
   iii. analyze the baseline behavior data to determine a unique threshold value of the user that is different from the baseline behavior data;
   iv. compare one or more subsequent datasets, each comprising shave data of one or more corresponding shave events, to the unique threshold value of the user to determine comparison data, and;
e. providing, based on the comparison data, an indication via the grooming device to indicate a deviation from the threshold value and to influence the user behavior.

2. The sensor-based shaving method of claim 1, wherein the shave event sensor is communicatively coupled to the grooming device, a charger of the grooming device, a base station of the grooming device, or a computing device having a processor executing a digital application.

3. The sensor-based shaving method of claim 1, wherein the shave event sensor comprises a displacement sensor, a load sensor, a movement sensor, an optical sensor, an audio sensor, a temperature sensor, a mechanical button, an electronic button, or a software button.

4. The sensor-based shaving method of claim 1, wherein the first dataset comprises data defining one or more shaving strokes, one or more shaving sessions, or one or more user inputs.

5. The sensor-based shaving method of claim 1, wherein the unique threshold value is a load value, a shave count, a stroke count, a stroke direction, a stroke speed, a stroke frequency, a stroke distance, a stroke duration, a shave duration, a stroke location, a shave location, a temperature value, a device parameter, a hair parameter, or a skin parameter.

6. The sensor-based method of claim 1, wherein the comparing of the one or more subsequent datasets to the unique threshold value of the user to determine comparison data is implemented by an offboard processor communicatively coupled to the grooming device via a wired or wireless computer network, the offboard processor configured to execute as part of at least one of: a base station of the grooming device, a mobile device, or a remote computing device.

7. The sensor-based method of claim 1, wherein the comparing of the one or more subsequent datasets to the unique threshold value of the user to determine comparison data is implemented by an onboard processor onboard the grooming device.

8. The sensor-based shaving method of claim 1, wherein the baseline behavior data of the user is calculated based on a total value of the first dataset, an average value of the first dataset, a maximum value of the first dataset, a minimum value of the first dataset, an average peak value of the first dataset, a frequency of the first dataset, or an integration of the first dataset.

9. The sensor-based shaving method of claim 1, wherein the unique threshold value of the user is calculated based an offset, a percentile, an average, or a statistical derivation from the baseline behavior data.

10. The sensor-based shaving method of claim 1, wherein the comparison data comprises a positive value, negative value, a neutral value, an absolute value, or a relative value.

11. The sensor-based shaving method of claim 1 further comprising post processing data generated by the application of one or more of signal smoothing, a hysteresis analysis, a time delay analysis, or signal processing to the comparison data, wherein the indication is further based on the post processing data.

12. The sensor-based shaving method of claim 1, wherein the communication device is communicatively coupled to the grooming device, a charger of the grooming device, a base station of the grooming device, or a computing device having a processor executing a digital application.

13. The sensor-based shaving method of claim 1, wherein the indication comprises a visual indicator, a light emitting diode (LED), a vibrator, an audio indicator, or a display indication as implemented via an application (app).

14. The sensor-based shaving method of claim 1, wherein the communication device comprises a wired connection, a Bluetooth connection, a Wi-Fi connection, or an infrared connection.

15. The sensor-based shaving method of claim 1, wherein the communication device is configured to provide the indication directly to the user or to another device.

16. The sensor-based shaving method of claim 1, wherein the communication device is configured to provide the indication directly to the user, wherein a positive state is indicated via a green signal, and wherein a negative state is indicated via a red signal.

17. The sensor-based shaving method of claim 1, wherein the indication provided by the communication device is customizable by the user.

18. The sensor-based shaving method of claim 1 further comprising analyzing the baseline behavior data to determine a second unique threshold value of the user, the second unique threshold value different from the baseline behavior data.

19. The sensor-based shaving method of claim 1, further comprising analyzing the one or more subsequent datasets to determine one or more types of shave strokes.

20. The sensor-based shaving method of claim 19, wherein a type of shave stroke comprises a direction, a speed, a frequency, a hair cutting status, a hair hydration, a skin hydration, a blade age, a blade wear, a shave prep status, a lubrication level, a friction level, a temperature, a humidity, an overstroke status, a facial zone, a body location, a geographical location, or a local weather condition of a shave stroke.

21. The sensor-based shaving method of claim 19 further comprising comparing different ones of the one or more types of shave strokes to each of the unique threshold value and a second unique threshold value, wherein the unique threshold value is different from the second unique threshold value.

22. The sensor-based shaving method of claim 1, wherein the unique threshold value is adjustable by the user.

23. The sensor-based shaving method of claim 1 further comprising determining, upon a manual update request of the user, an updated unique threshold value based on the one or more subsequent datasets.

24. The sensor-based shaving method of claim 1 further comprising training a sensor-based learning model communicatively coupled to the shave event sensor, the sensor-based learning model trained with the data of at least the first dataset, the sensor-based learning model configured to analyze the one or more subsequent datasets to adjust the unique threshold value of the user.

25. The sensor based shaving method of claim 24, further comprising retaining the sensor-based learning model upon an occurrence of a pre-determined trigger situation.

26. The sensor-based shaving method of claim 24, wherein the sensor-based learning model is further trained with user profile data.

27. The sensor-based shaving method of claim 1, further comprising collecting user profile data and analyzing the user profile data with the baseline behavior data to determine the unique threshold value of the user.

28. The sensor-based shaving method of claim 1, further comprising generating the comparison data during collection of the first dataset by comparing at least a portion of the first dataset to either a pre-determined threshold value, a threshold value manually selected by the user, or a threshold calculated based on datasets collected from other relevant users.

29. The sensor-based shaving method of claim 28 further comprising providing, based on the comparison data, the indicator via the communication device during the collection of the first dataset.

30. The sensor-based shaving method of claim 1 further comprising collecting calibration data from the grooming device.

31. The sensor-based shaving method of claim 30, further comprising comparing unique threshold values or datasets between different users or groups of users.

32. The sensor-based shaving method of claim 1, further comprising receiving previously collected user profile data for a different grooming device, and configuring the grooming device with the unique threshold value based on the user profile data.

33. The sensor-based shaving method of claim 32, further comprising adjusting the previously collected user profile data to match characteristics of the grooming device, wherein the grooming device is a new device.

34. The sensor-based shaving method of claim 1, wherein the grooming device comprises at least one of an electric shaver, a shaving razor, or an epilator.

35. A sensor-based shaving system configured to analyze a user's shave event for determining a unique threshold value of the user, the sensor-based shaving system comprising:

a grooming device having (i) a handle comprising a connecting structure, and (ii) a hair cutting implement, the hair cutting implement being connected to the connecting structure;

a shave event sensor configured to measure a user behavior associated with a shave event of a user;

a communication device; and a processor, configured onboard or offboard the grooming device, and communicatively coupled to the shave event sensor and the communication device, wherein the processor is configured to execute computing instructions stored on a memory communicatively coupled to the processor, the instructions causing the processor to:

collect a first dataset from the shave event sensor, the first dataset comprising shave data defining the shave event, analyze the first dataset to determine baseline behavior data of the user, analyze the baseline behavior data to determine a unique threshold value of the user that is different from the baseline behavior data, compare one or more subsequent datasets, each comprising shave data of one or more corresponding shave events, to the unique threshold value of the user to determine comparison data, and, provide, based on the comparison data, an indication to indicate a deviation from the threshold value and to influence the user behavior.

* * * * *